US006326862B1

(12) United States Patent
Ferguson et al.

(10) Patent No.: US 6,326,862 B1
(45) Date of Patent: Dec. 4, 2001

(54) TUNED REACTANCE CAVITY ELECTRICAL TERMINATION

(75) Inventors: Donald A. Ferguson; Martin Gottschalk, both of Stuart, FL (US)

(73) Assignee: Florida RF Labs, Inc., Stuart, FL (US)

( * ) Notice: Subject to any disclaimer, the term of this patent is extended or adjusted under 35 U.S.C. 154(b) by 0 days.

(21) Appl. No.: 09/394,721

(22) Filed: Sep. 13, 1999

(51) Int. Cl.[7] ..... H01P 1/26
(52) U.S. Cl. ..... 333/22 R
(58) Field of Search ..... 333/22 R

(56) References Cited

U.S. PATENT DOCUMENTS

| | | | | |
|---|---|---|---|---|
| 3,678,417 | * | 7/1972 | Ragan et al. | 333/22 R |
| 3,790,904 | * | 2/1974 | Lesyk et al. | 333/22 R |
| 5,598,131 | * | 1/1997 | Mazzochette | 333/22 R |
| 6,016,085 | * | 1/2000 | Mazzochette | 333/22 R |

OTHER PUBLICATIONS

Component Reference Sheet, Model No. 34–1002, Temperature Sensing High Power Termination, Florida RF labs, Inc., pp. 1–2, Jan. 1999.

* cited by examiner

*Primary Examiner*—Robert Pascal
*Assistant Examiner*—Stephen E. Jones
(74) *Attorney, Agent, or Firm*—Gunster, Yoakley & Stewart, P.A.

(57) ABSTRACT

An electrical termination system includes an electrical contact electrically connected to an RF resistor (224). A housing (102) at least partially encloses the RF resistor (224). In one alternative, the housing (102) includes an electrically conductive surface located at a first distance relative to the RF resistor (224) to provide a reactance at the RF resistor (224) to reduce reflected energy at the electrical contact for a wide band RF signal present at the electrical contact. In a second alternative, a surface of a dielectric substrate (602) is located substantially adjacent to the RF resistor (224) to provide a reactance at the RF resistor (224) to reduce reflected energy at the electrical contact.

8 Claims, 2 Drawing Sheets

TUNED REACTANCE CAVITY ELECTRICAL TERMINATION

FIELD OF THE INVENTION

This invention relates in general to electrical termination systems, and more particularly to a tuned reactance cavity in an electrical termination circuit.

BACKGROUND OF THE INVENTION

Electrical termination systems are commonly used for providing electrical termination to electrical signals present in electrical circuits. Typically, an electrical termination system attempts to provide a predefined impedance or load, such as a fifty ohm impedance, between a signal line and a reference line, such as a ground reference, in an electrical circuit. Ideally, a termination system should provide a constant predefined impedance for a wide range of electrical signal frequencies. Examples of termination systems include, but are not limited to, radio frequency (RF) loads for frequency circulators, couplers, power combiners, absorptive filters, and antenna replacement dummy loads.

Typically, terminations are present in RF & microwave systems to absorb unwanted signals which may otherwise cause component instabilities, distortion products, or component damage. High power terminations were historically large planar resistors exhibiting poor RF impedance due to large parasitic shunt capacitance. The introduction of internally matched stripline devices offered designers drop-in wide band low VSWR with no need for external matching. While a great step forward in performance, internally matched terminations require more attention to the design of the launch from the electrical circuit to the termination to achieve rated performance. Clever designers found that although these termination devices were internally matched, their performance could be further optimized over a narrow range of frequencies with external matching. Being a stripline component, the termination's performance may also be adversely affected by the proximity of other components or enclosure walls and covers. As wireless systems demand isolators with greater isolation and couplers with greater directivity, a better solution is required.

As an example, a radio frequency (RF) signal is terminated via a fifty ohm impedance to ground by electrically coupling a fifty ohm resistor between an RF signal line and a ground reference line in the electrical circuit. The fifty ohm resistor, in this example, is electrically coupled between the signal line and the ground line using a length of coaxial cable. The coaxial cable includes an electrical connector to mate with an electrical connector electrically coupled with the electrical circuit thereby making electrical interconnection of the fifty ohm impedance with the electrical circuit a relatively quick process for a technician to perform.

Such exemplary electrical termination systems as discussed above traditionally have been enclosed in a housing of aluminum or copper. The housing provides an internal cavity and a plane therein to which a ceramic fifty ohm resistor is soldered and used to terminate an RF signal coupled thereto via a coaxial cable. The ceramic fifty ohm resistor termination can be directly contacting the conductor of the coaxial cable or, alternatively, the resistor may be electrically coupled to the conductor of the coaxial cable via an electrical coupling structure, such as an electrical circuit disposed on a sheet metal arrangement, to electrically couple the ceramic fifty ohm resistor termination with the conductor of the coaxial cable.

To provide a fifty ohm termination to the electrical circuit as described above, a high degree of care must be taken in designing and making the electrical termination system. The termination system must be designed and constructed to closely match the electrical transition via the coaxial cable from the electrical circuit to the termination resistor to a fifty ohm transition to reduce reflective energy coming back out of the electrical termination system into the electrical circuit to be terminated. This matching must be effective for all the relevant signal frequencies that would be present at the signal line and that require a fifty ohm termination to ground.

The fifty ohm termination resistor is normally enclosed in the cavity of the metal housing to electrically seal up, as an electrical shield, the termination resistor in the cavity and to protect the termination resistor from the elements such as dust.

Unfortunately, the termination system described above requires significant labor and technical craftsmanship to get a fairly good fifty ohm transformation via the coaxial cable into the RF resistor. The sad fact is that most such termination systems have resulted in electrical mismatching of the termination to a corresponding electrical circuit, increased reflection of energy from the termination, and very specific operation only within a narrow bandwidth of frequencies for an electrical signal. Furthermore, each high-power RF resistor used for such termination normally has associated with it unwanted electrical parasitics, such as excess capacitance and inductance, which make it very difficult to design a standard termination system that matches an electrical circuit while trying to get an electrical signal over a wide band of frequencies into the fifty ohm resistor and then down to ground.

To deal with this problem, a conventional termination system normally requires tuning of the termination circuit for each termination system to try to get an effective matching circuit. During manufacture and assembly of such a termination system, a technician typically has to tune each electrical circuit termination to try to get low reflections out of each such termination. This tuning typically involves changing electrical circuit components in the termination circuit and/or varying a length of a coaxial cable for interconnecting the termination system to an electrical circuit. This regrettably requires a lot of manual labor to make each termination system, and typically specified for operation in a narrow range of frequencies for a particular application for the termination system.

Additionally, this tuning adds significant burden to a technician when assembling together the coaxial cable with the termination device. It requires the technician to be very careful about the placement of the circuit elements you put together and the amount of solder used in solder joints and things of that nature. And when done tuning the termination, the device is typically specific to a narrow range of frequencies for an application. In other words, it is not a generic device that would plug into various electrical circuit designs. It typically would be useful only for one electrical circuit design. In general, tuning is done on each individual termination system that is produced, not by design. This adds significant cost to mass manufacturing of termination systems due to 1) the recurring technician labor for tuning each termination system, and 2) the requirement to stock different types of termination systems for different narrow bands of frequencies and applications. In addition to being very careful how each termination system is tuned during manufacturing, customers have to be very careful about the length of the coaxial cable used with the termination system. Essentially, the fact that the termination system is tuned to a very narrow band of frequencies also gives a significant ripple or change in magnitude of reflected energy over frequency and the length of the coaxial cable must be carefully selected to minimize energy reflection into the customer's electrical circuit at a certain frequency band. Unfortunately, the length of the coaxial cable becomes very critical in the operation of the termination system. Conventional termination systems, consequently, have been very ad hoc and customized solutions on a per application basis.

Thus, there exists a need for a termination system that does not have the aforementioned disadvantages of the prior art. Particularly, it would be very desirable for a termination system to 1) have low reflections of energy across a range of frequencies, 2) not require technician tuning for each individual termination system, 3) work over many different applications for many different systems and not have to be customized for each specific application, and 4) achieve desired performance irrespective of the coaxial cable length used to electrically couple the termination system to a specific electrical circuit for an application.

DESCRIPTION OF THE PREFERRED EMBODIMENT

Figure 1:
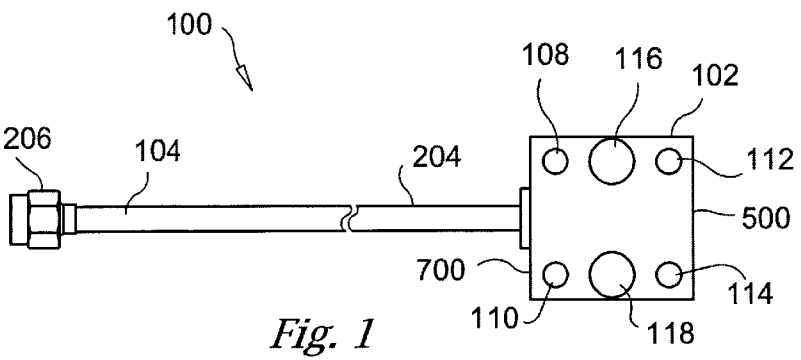
FIG. 1 is a bottom planar view of a termination system in accordance with a preferred embodiment of the present invention.
Figure 2:
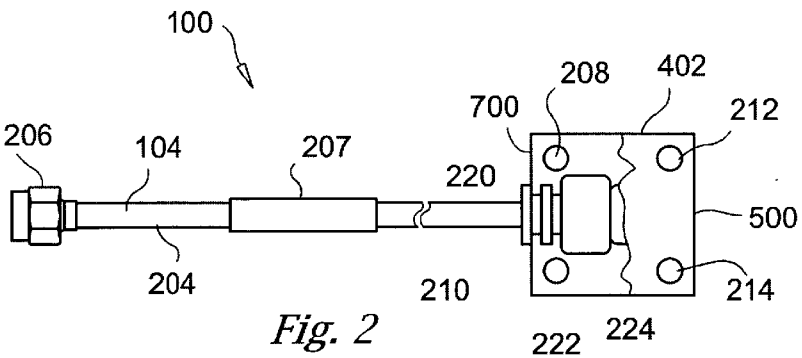
FIG. 2 is a bottom planar cut-away view of a termination system in accordance with a preferred embodiment of the present invention.

Referring to FIGS. 1 and 2, a stepped reactance cavity tuned termination system 100 comprises a high power planar chip termination circuit element 502 (or resistive element) mounted on a dielectric substrate 224 and at least partially enclosed within an electrically conductive enclosure or housing 500. The system 100 also includes a transmission line electrical input such as a coaxial cable 104. A terminal of the termination circuit element 502 is electrically connected to the housing 500 (electrical ground) and one terminal is electrically connected to the coaxial cable 104. The housing 500 preferably forms an electrically conductive cavity which interacts with the impedance of the termination circuit element 502 and the coaxial cable 104. The conductive cavity cross-section dimensions and/or loaded dielectric constants vary from the input to the ground end of the termination circuit element 502 in one or more discrete steps. These steps result in corresponding discrete cavity impedances whose interactions with the termination circuit element 502 accomplish wide band impedance matching of the termination system 100.

Typically, high power radio frequency termination resistors have high parasitic imaginary impedances which prohibit them from exhibiting a wide band constant input impedance. Traditionally, narrow band microstrip and coaxial impedance matching techniques (up to several hundred MHz wide) have been used to obtain a very low voltage standing wave ratio of less than 1.05:1 typical at specific operating frequencies. Narrow band devices are useful only for the specific frequency application to which they were matched. Stepped reactance cavity tuned terminations exhibit wide band impedance matching for voltage standing wave ratios less than 1.05:1 typical over several GHz. Wide band performance allows one device to be used for many applications or for multiple frequency band applications.

A preferred embodiment of the present invention comprises the coaxial remote termination (CRT) 100. The CRT 100 comprises the termination circuit element 502 in the housing 500 with the coaxial cable 104 in accordance with the present invention. The CRT 100 offers very low Voltage Standing Wave Ratio (VSWR) performance, such as required for wireless communication applications up to 150 Watts and for C-band applications up to 60 Watts. The termination circuit element 502, the dielectric substrate 224, launch 222, the thin film transmission line 501 and an impedance matching network (not shown) collectively make up a resistive subassembly 651. The resistive subassembly 651 is preferably mounted in the rugged aluminum housing 500, as will be discussed below. The housing 500 preferably comprises a housing base and cover (402 and 404 respectively) that are mated together to form the housing 500. Preferably a set of screw holes 108, 110, 112, 114, 208, 210, 212 and 214 accept a set of screws (not shown) to secure the housing cover 404 and base housing 402 together. Optionally, the housing 500 may be fitted with feet 116 and 118 to provide a convenient support structure for the housing 500 in certain housing mounting arrangements. Further, in another optional configuration, the coaxial cable 104 includes a cable grip 207 to facilitate a person handling the coaxial cable 104 in an application.

The housing 500 shields the system 100 from undesired electromagnetic radiation and makes the system 100 relatively immune to detuning from other external circuits, components, and enclosures. Because the electrical environment is well defined and consistent with the CRT 100, the launch 222 and impedance matching can be optimized for ultra-low wide band VSWR, e.g., over a frequency range of several gigahertz. The performance of terminated circulators and couplers directly relates to the termination's VSWR or return loss in dB. The typical return loss for cellular and PCS bands is greater than 32 dB (1.05:1 VSWR). This allows a designer to achieve greater than 32 dB isolation in a single junction high power isolator. Because the performance is wide band, and not merely nulled at a specific frequency, one CRT part type may be used in many different applications.

The unique transmission line input offers greater mechanical design flexibility. The electrical location of a termination in a system is often not a good place for a large high heat dissipating device. Isolators and power combining couplers are usually located nearby high power transistors which are heat sensitive and are already dissipating large amounts of heat into a chassis. Circulator ferrite materials are also sensitive to detuning or degradation from heat. While other heat generating components may be difficult or impossible to relocate, CRT's 100 can include relatively long coaxial cable 104 lengths, such as up to 100 inches or more, and are relatively easy to design into a cooler temperature location in a system. The CRT's 100 aluminum housing 500 and all solder construction efficiently transfer the heat from the termination circuit element 502 to the bottom surface of the housing base 402. The housing base 402 also spreads the heat uniformly over the large mounting area for good heat transfer to the system chassis or heat sink.

Although the coaxial cable 104 can be launched vertically through the housing cover 404 or base 402, coaxial cable 104 can alternatively be launched through other housing walls, as shown in FIGS. 1 and 2, such as horizontally through a housing side wall 700. The coaxial cable 104 is preferably flexible or semi-flexible and is easily formed by hand into complex bends without the need for forming tools. In the preferred embodiment, the coaxial cable 104 input length is selected from the range of 1 inch to 100 inches, depending on the application. Preferably, a standard connector 206, such as a standard connector type SMA plug, is used with the coaxial cable 104 input. Other alternative coaxial transmission lines, lengths, and connectors are also anticipated within the scope of the present invention.

Figure 4:
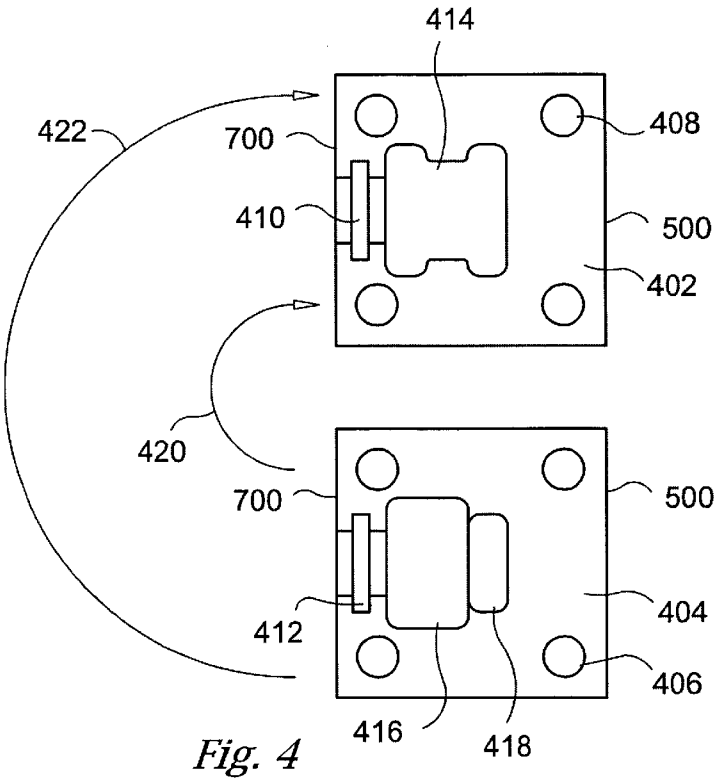
FIG. 4 is a top planar view of a housing cover and base for a termination system according to a preferred embodiment of the present invention.
Figure 3:
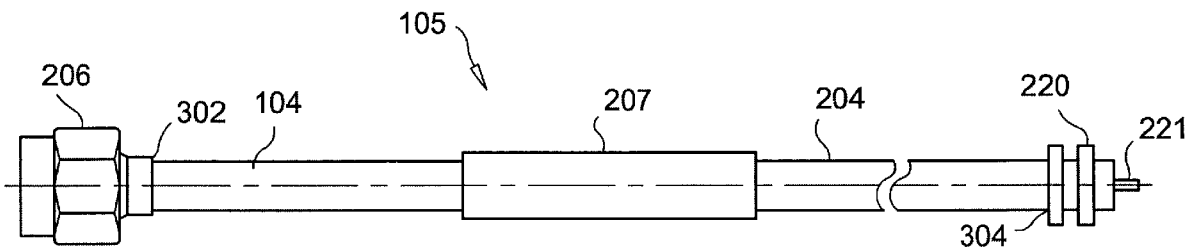
FIG. 3 is a side planar view of a coaxial cable for use with a termination system according to a preferred embodiment of the present invention.
Figure 5:
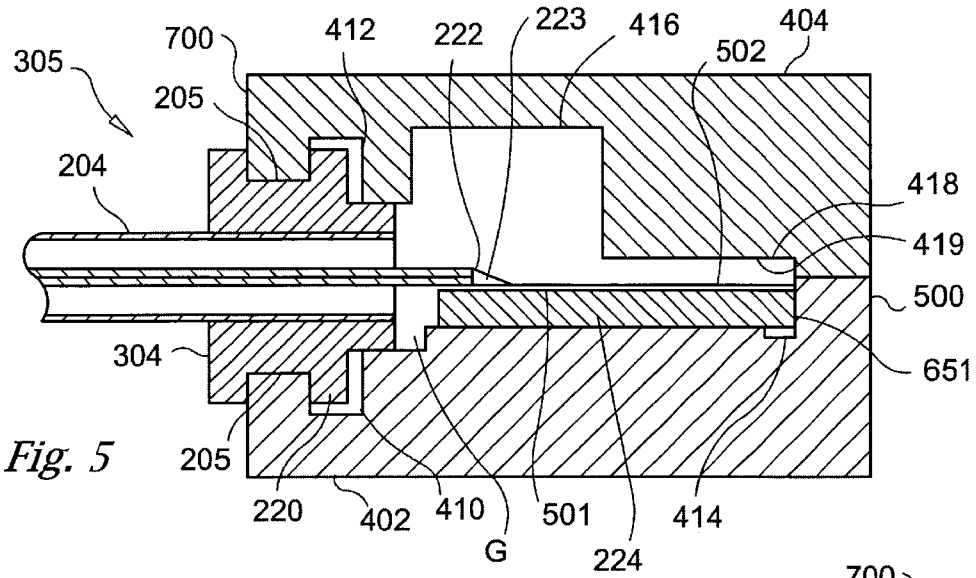
FIG. 5 is a side cut-away view of a termination system according to a preferred embodiment of the present invention.

Referring now to FIGS. 1–6, a coaxial cable subassembly 105 comprises the coaxial cable 104, the connector 206, (in this exemplary case an SMA connector, an industry standard for connecting a termination device to the outside world), and on the other end a cable collar 220, (also known as a cable adapter), which is a mechanical element soldered to the coaxial cable 104 that mates with the housing base 402 and cover 404 when captured in a pinched assembly. The cable collar 220 mates and is captured by a cavity 410 in the housing base 402 and a corresponding cavity 412 in the housing cover 404. When the housing cover 404 is located on the base 402, as indicated by arrows 420 and 422, the cable collar 220 is captured and the coaxial cable 104 is secured to the housing 500. Note that a screw hole 408 in the housing base 402 matches with a screw hole 406 in the housing cover 404 to create the screw holes in the housing 500, such as the four screw holes 108, 110, 112 and 114, shown in FIG. 1. Further, as shown in FIG. 5, a second cable collar 304 is used to provide a secure seal 205 at a housing mating entrance 305. This seal 205 helps to maintain a good seal between the housing mating entrance 305 and the coaxial cable 104 entering the housing 500 therein. Furthermore, the optional cable grip 207 can be used to provide convenient handling of the coaxial cable 104 by a person using the CRT 100. Lastly, as shown in FIG. 3, an inner conductor 221 of the coaxial cable 104 is extended beyond the end of an outer conductor 204 of the coaxial cable 104 to provide for the launch structure 222 that is electrically coupled to the termination circuit element 502. The CRT 100 in FIG. 5 also includes dual cavities 416 and 418 and will be discussed in more detail below with respect to reducing reflections at an electrical contact via the coaxial cable 104. The coaxial cable subassembly 105, as discussed above, can range in cable length to meet specific application mechanical requirements without concern for degrading electrical performance of the CRT 100 as will be discussed in more detail below.

The Coaxial Remote Termination (CRT) 100, in accordance with the present invention, offers outstanding electrical performance and design flexibility for wireless and hi-reliability applications. Each Coaxial Remote Termination 100 mounts and performs consistently from unit-to-unit ensuring fast high yield system production. The ability to use high power devices with ultra-low VSWR in medium power systems increases system reliability through larger derating margins and cooler operation.

CRTs 100 provide good termination performance and very low reflections typically across a wide range of frequencies requiring no tuning. CRTs 100 would work over many different applications for many different systems and over a wide range of frequencies, and consequently do not have to be customized for any specific application. In addition, the CRT 100 performance is achieved generally irrespective of the coaxial cable 104 length. Therefore, for example, the coaxial cable 104 length going into the CRT 100 does not have to be a specific length for a particular range of operating frequencies of a system. The CRT's 100 coaxial cable 104 length accordingly could be optimized for a system's mechanical requirements without concern to meeting the system's electrical requirements.

Figure 6:
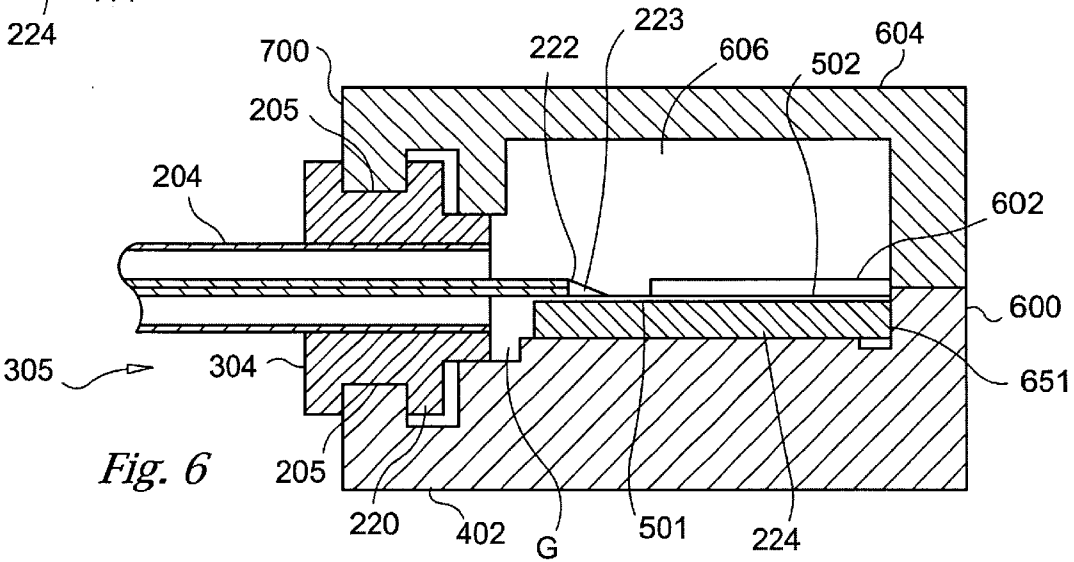
FIG. 6 is a side cut-away view of an alternative arrangement of a termination system according to a preferred embodiment of the present invention.

Generally, to design and build the housing 500 with at least one cavity 416 and 418, as illustrated for example in FIG. 5, and as alternatively illustrated by a cavity 606 in FIG. 6, one can measure electrical reflections at an electrical contact in the electrical system that is electrically coupled to the coaxial cable 104 (or alternatively one can measure at an electrical contact point at the coaxial cable 104) and as the reflections are occurring in a time domain, such as by using a network analyzer. By looking at the time that it took for a signal to reflect back, one can measure physically where that reflection occurred in the housing cavity structure. In this way, one can measure and characterize at least one cavity 416 and 418, for a housing to minimize reflections (i.e., the energy level of a reflected signal) caused at the at least one electrical contact by internal cavity structures and dimensions. Preferably, a dual cavity housing provides better low reflection performance than a single cavity housing, as will be discussed below.

Most prior art custom termination systems have the disadvantage of using microstrip signal transmission technology. In other words, the technology where there is a ground plane, a dielectric, a transmission line conductor on the top surface of the dielectric and the resistor also on the top surface of the dielectric and then air on top of the device or a complete ceramic cover on top of the entire termination device and then air. Microstrip has a number of disadvantages due to a characteristic called dispersion where electrical wave travels at one speed within the dielectric and a different speed above the dielectric in the air because of the differences in electrical dielectric constant. That dispersion results in varying reflections, which are the undesirable signals that we are trying to minimize.

The preferred embodiment of the present invention exhibits such good performance over such a wide range of frequencies that the CRT 100 need not be tuned or customized for any particular application and system. Additionally, this performance can be attained for different lengths of the coaxial cable 104 electrically coupling the CRT 100 to an electrical contact in an electrical system.

The present invention clearly deviates from a prior art microstrip approach. The preferred embodiment compensates the upper wave above the termination circuit element 502 traveling at a different speed than the wave traveling within the dielectric substrate 224 as will be discussed in detail below. The preferred embodiment, utilizes a dual cavity approach within the housing 500 instead of having a large hollow cavity in which the structure is built in. The CRT 100 uses the cavity as an electrical element in the termination circuit. The CRT 100 includes dual steps in the height of the housing cover 404 over the termination circuit element 502 and over the transition from the coaxial cable 104 to the termination circuit element 502, which are both optimized electrically to minimize reflections (i.e., the energy of a reflected signal) from the CRT 100 via the coaxial cable 104. As you enter the CRT 100 via the coaxial cable 104, the coaxial cable outer conductor 204 stops at some point and the inner conductor 221 of the coaxial cable 104 continues forward and protrudes out of the outer conductor 204. The inner conductor 221 then makes electrical attachment to the termination circuit element 502 or to the thin film transmission line 501 electrically coupled to the termination circuit element 502 on the dielectric substrate 224. This is shown, for example, in FIG. 5. The termination circuit element 502 acts a first electrical load element and the thin film transmission line 501 functions as a second electrical load element because of the resistance each offers to an input signal feeding into the CRT 100. As is known in the art, the input signal is converted into heat energy as the signal travels through the both the thin film transmission line 501 and the termination circuit element 502 respectively. In this way, a dual electrical load system is utilized by the CRT 100 to terminate signals fed therein.

At that point, the thin film transmission line 501 on the dielectric substrate 224 is a very thin item in the range of less than one-thousandth of an inch and its dimensions are typically designed electrically to be 50 ohms at that point with a very thin conductor. When the inner conductor 221 of the coaxial cable 104 is attached to that point with a solderjoint 223, it forms the launch 222 structure that is higher than optimum and adds a capacitance, which is an unwanted parasitic at that electrical junction. In order to suppress that capacitance, a small air gap G is provided between the outer conductor 204 of the coaxial cable 104 and the dielectric substrate 224. In other words, instead of having the outer conductor 204 butted up tight against the dielectric substrate 224, the preferred embodiment provides the controlled air gap G which creates a series inductance on the inner conductor 221 of the coaxial cable 104 which helps to resonate out and compensate for the extra capacitance induced by the solder joint 223. Additionally, to further minimize any remaining excess capacitance of the solder joint 223, the housing 500 includes the very tall cavity 416 above the solder joint 223. In other words, as shown in FIG. 5, a preferably 150-mil. deep cavity is machined into the housing cover 404 to keep the housing cover 404 far away from the solder joint 223, thereby reducing the parasitic capacitance of the solder joint 223.

Then traveling down the electrical conductor from the solderjoint 223 towards the termination circuit element 502 preferably is a small inductor matching element (not shown) to match the termination circuit element 502. Then traveling further the thin film transmission line 501 enters the termination circuit element 502 itself. The termination circuit element 502 is preferably either a large nickel chromium or ruthenium-based thick film resistor which is trimmed to a value of 50 ohms. The termination circuit element 502, in an RF application, provides termination and turns the unwanted RF signal into heat energy without reflecting RF signal energy back out of the termination circuit element 502.

The thin film transmission line 501 shares the wave dispersion characteristics of the RF signal. The open air cavity 418, with an upper inner surface 419 over, and in relatively close proximity to, the termination circuit element 502, manipulates the upper electrical wave over the termination circuit element 502. As shown in FIG. 5, the first deep cavity 416 steps down to a shallow cavity 418 locating the housing cover 404 in close proximity to the termination circuit element 502. These two cavity depths preferably range as follows.

The deep cavity 416 preferably ranges from approximately 150 mils to upwards of 250 mils deep. The taller the cavity 416 the better. If one is willing to accept reduced performance, however, the cavity 416 can be made shallower. But, it will directly reduce the performance relative to the reduced height of the cavity 416. A theoretically "infinite" height cavity, such as an open hole over the particular region, would actually work better electrically but would be undesired as a commercial item because of the ability of moisture and dust to get into the housing 500. Additionally, electrical and electromagnetic radiation would leak out of the housing 500 causing other concerns for using the CRT 100 in an application.

The shallow cavity 418 preferably ranges from 10 mils to approximately 50 or 60 mils, depending on the termination circuit element 502 being compensated. 24 mils is an optimum height for compensating the termination circuit element 502 such as shown in FIG. 5. The termination circuit element 502, for example, is commercially available from Florida RF Labs, Inc., a Florida Corporation, under a part number 82-1023. The optimum depth for the shallow cavity 418 of the housing cover 404 depends on the size and the geometry of the dielectric substrate 224 and the termination circuit element 502 being compensated.

The dual step cavity arrangement, according to the preferred embodiment of the present invention, operates to tune the electrical characteristics of the CRT 100 to reflect a much lower amount of RF power than has been achieved before by a termination device at this power and frequency level. This variable depth cavity arrangement, in accordance with the present invention, would improve the performance of most termination element parts.

FIG. 4 illustrates the arrangement of the housing base 402 and the housing cover 404 of the housing 500. The housing base 402, (see also FIG. 5), provides a mechanical base supporting the dielectric substrate 224. It also has a cavity 414 comprising a solderable plane to which the dielectric substrate 224 is soldered. This provides an electrical ground for the termination circuit element 502 and also provides a very low thermal resistance path for the waste heat which is generated by the CRT 100 during operation. The waste heat flows vertically downward through the housing base 402 through the bottom of the housing 500 where the CRT 100 can be attached to a heat sinking arrangement (not shown) using a water-cooled or air-cooled structure or other structure to remove the heat from the CRT 100. In addition, the housing base 402 also provides a mechanical structure to attach the coaxial cable 104 to when making the solder joint 223 between the coaxial cable inner conductor 221 and the termination circuit element 502. The final assembly operation is to cover and compress, as shown by arrows 420 and 422, the housing cover 404 which has the cavities 416 and 418 onto the housing base 402 which also provides an additional mechanical capture for the coaxial cable 104 and closes the housing 500 to seal it electrically and physically (e.g., protecting from external elements and contaminants).

An alternative embodiment, as shown in FIG. 6, provides a similar dual stepped reactance cavity arrangement by locating a second dielectric layer 602 in close proximity to the termination circuit element 502 to compensate for the termination circuit element 502 by dielectric loading. This is different than providing a full dielectric layer, such as a ceramic cover, to cover over the entire dielectric layer 204. Such a cover is commonly used to mechanically protect a resistor element and also to reinforce a solderjoint of the lead contact coming in to a chip resistor device. While this cover approach provides some dielectric loading to a chip resistor element, it also provides undesirable dielectric loading over an entire resistor device including an input solder joint where a tab lead comes in to a chip resistor device. This cover arrangement, in general, degrades the performance of a chip resistor device.

In an alternative preferred embodiment of the present invention, the single-height cavity 606 in a housing cover 604 can be stepped in reactance over the resistive subassembly 651 by utilizing the second dielectric layer 602 located substantially over the termination circuit element 502, but not over, or adjoining to, the solder joint 223 (about the thin film transmission line 501 and launch structure 222) where the inner conductor 221 comes in to the termination circuit element 502. This novel arrangement of structures compensates the termination circuit element 502 using the second dielectric layer 602 (partial ceramic cover) over the termination circuit element 502 and compensates for the solder joint 223 in the circuit by using the air dielectric in the cavity 606 over the solderjoint 223 (about the launch structure 222) of the termination circuit.

In such a case, the coaxial cable 104 comes in to a housing 600 and it is captured mechanically by the housing 600. The solder joint 223 is formed between the inner conductor 221 of the coaxial cable 104 and the thin film transmission line 501. This creates the launch structure 222 for the coaxial cable 104. The solder joint 223 is not covered with a ceramic cover. The solder joint 223 is left uncovered and exposed to the air in the cavity 606, preferably about 150 mils deep, providing the compensation to that portion of the circuit. Preferably, the cavity 606 height is kept high above the solder joint 223 to reduce the solder joint's 223 parasitic capacitance.

Then, for example, instead of creating a physical step down in the cavity 606 of the housing 600 to compensate for the upper field in the termination circuit element 502, as was discussed above with reference to FIG. 5, the cavity 606 height does not have to physically change, as illustrated in FIG. 6. Electrically the reactance of the cavity 606 is stepped over the termination circuit element 502 by providing the second dielectric layer 602, (e.g., a partial ceramic cover), in close proximity to the termination circuit element 502 to provide dielectric loading thereon. This is accomplished with the second dielectric layer 602 partially covering over the dielectric substrate 204. For example, the second dielectric layer 602 covers approximately one-half of the dielectric layer 204, e.g., substantially covering the termination circuit element 502 of the resistive subassembly 651 to dielectrically load the termination circuit element 502 and compensate for the upper field over the termination circuit element 502.

Preferably, the second dielectric layer 602 only covers the termination circuit element 502 of the resistive subassembly 651, and leaving typically a larger portion of the dielectric layer 204, that contains the input matching circuit structure, thin film transmission line 501, solder joint 223 and launch structure 222 exposed to the air in the cavity 606.

The second dielectric layer 602 is preferably an unmetalized chip of dielectric material which is typically a substrate of ceramic with aluminum oxide. The second dielectric layer 602 is typically twenty thousandth of an inch thick and designed with X and Y dimensions as required to cover the termination circuit element 502 of the resistive subassembly 651. So, again, the second dielectric layer 602 dimensions vary with the dimensions of the termination circuit element 502 of the resistive subassembly 651. The second dielectric layer 602 is a separate discrete element which is bonded with a non-conducting or dielectric-type epoxy adhesive directly to the top of the termination circuit element 502 of the resistive subassembly 651.

In summary, in a first preferred embodiment of the present invention, the dimensions of the cavity can be varied, or stepped, to provide varying air dielectric to step reactance over the termination circuit to improve the performance of the termination circuit as discussed above. In the second alternative, the dimensions of the cavity of the housing do not need to change, and instead the separate second dielectric layer 602, such as a ceramic cover, is located substantially over the termination circuit element 502 to compensate for the termination circuit element 502 with a stepped reactance to reduce parasitic capacitance of the termination circuit element 502, while allowing a separate different dielectric, such as air in the cavity 606, to compensate for the termination circuit about the solder joint 223 and transmission line 501 of the resistive subassembly 651 to provide the stepped reactance over the dielectric layer 204. Of course, other dielectrics can be used across the resistive subassembly 651 to create the stepped reactance effect to significantly improve the performance of the CRT 100 by reducing the reflected energy of the termination of an electrical signal being terminated into the CRT 100.

This termination arrangement can serve multi-applications over a wide band of signal frequencies. The design does not need tuning to operate with different applications. Further, the length of the coaxial cable is generally not a concern in the termination's performance. In the past, termination designers trying to get a minima of reflections in a specific range of frequencies would have to design the length of the coaxial cable into the electrical characteristics of their termination circuit device. The CRT 100, according to the present invention, provides such superior performance over known prior art termination devices that the reflected signal peaks or maxima due to VSWR ripple are usually below the level of the minima achieved in prior art termination devices. In other words, one does not have to adjust the coaxial cable length to make sure that the minima fall in a certain range of frequencies. The minima and the maxima are suppressed so much in magnitude that they can essentially be ignored over a very wide frequency range—for many different applications.

For example, while a termination device in the past may have been optimized for cellular communication, such as for about 900 MHZ, and would consequently be useless for PCS, the new frequency for cellular ranging at about 1900 MHZ. With the present invention, one termination device can terminate for different applications for both systems over a very wide frequency range. It works equally as well for all of them. It approaches a flat response across the entire wide range of frequencies.

A stepped reactance cavity approach can utilize a plurality of steps over a termination circuit to provide customized compensation to portions of the termination circuit while minimizing reflections. Besides a dual step approach, as has been discussed above, a multi-step approach with more than two steps could be customized to further minimize reflections in a termination device. Such a multi-step approach, in one embodiment, could approach an inclined cavity surface providing varying dielectric steps, and varying reactance, over the length of a termination circuit matched to reduce and minimize reflections of signal energy at the various portions of the termination circuit.

Therefore, as has been described above, the present invention provides many significant advantages over the known prior art termination systems. It significantly reduces the reflections of energy from the termination device to provide outstanding performance over a wide range of frequencies. By changing the dielectric constant through the circuit to compensate and minimize those reflections at each portion of the termination circuit, a single design controls the transition of impedances through the termination circuit from the input all the way to the termination circuit element

502 and then through to the electrical ground lead for grounding the termination device. This is a significant advantage of the present invention that is not available in any known prior art termination system. Further, no known prior art termination system utilizes a specifically designed cavity to electrically interoperate with a termination circuit to reduce the energy reflected with reflection signals to enhance the performance of the termination circuit.

While the invention has been described in its preferred embodiments with some degree of particularity, it is understood that this description has been given only by way of example and that many variations can be made thereto without departing from the spirit and scope of the invention as set forth in the claims below.

What is claimed is:

1. A tuned reactance cavity electrical termination system comprising:

an electrical contact;

a cavity comprising a first electrically conductive surface and a second electrically conductive surface;

a first electrical load element electrically coupled to a second electrical load element, the first electrical load element and the second electrical load element being electrically coupled to the electrical contact, the first electrically conductive surface being located substantially parallel relative to the first electrical load element to provide a first reactance thereto and the second electrically conductive surface being located relative to the second electrical load element to provide a second reactance thereto, the first reactance and second reactance reducing reflected energy at the electrical contact for an electrical signal present at the electrical contact.

2. The tuned reactance cavity electrical termination system of claim 1, wherein the first electrical load element and the second electrical load element are disposed on a substantially planar surface within the cavity and the first electrically conductive surface is located at a first distance relative to the first electrical load element and the second electrically conductive surface is located at a second distance relative to the second electrical load element, the first distance being different than the second distance.

3. The tuned reactance cavity electrical termination system of claim 1, wherein the first electrical load element comprises surface mount radio frequency resistor.

4. The tuned reactance cavity electrical termination system of claim 1, wherein the first electrical load element and the second electrical load element are substantially enclosed in the cavity.

5. The tuned reactance cavity electrical termination system of claim 1, wherein the electrical signal comprises a wide band of radio frequencies at least several hundred megahertz wide.

6. An electrical termination system comprising:

at least one electrical contact;

a first electrical load element electrically coupled to the at least one electrical contact;

a housing at least partially enclosing the first electrical load element, the housing comprising a first surface substantially parallel to the first electrical load element to provide a reactance at the first electrical load element to reduce a reflected signal at the at least one electrical contact for an electrical signal present at the at least one electrical contact;

a second electrical load element electrically coupled to the at least one electrical contact and at least partially enclosed by the housing; and a second surface located relative to the second electrical load element to provide a reactance at the second electrical load element to reduce a reflected signal at the at least one electrical contact for the electrical signal present at the at least one electrical contact.

7. The electrical termination system of claim 6, wherein the second surface comprises a surface of a dielectric substrate located substantially adjacent to the second electrical load element.

8. The electrical termination system of claim 7, wherein the second electrical load element comprises a surface mount radio frequency resistor.

* * * * *